United States Patent [19]

Richardson et al.

[11] Patent Number: 4,460,293

[45] Date of Patent: Jul. 17, 1984

[54] MINE SHAFT LINER

[75] Inventors: Paul Richardson, Santa Ana; David A. Whitley, Brea, both of Calif.

[73] Assignee: Santa Fe International Corporation, Orange, Calif.

[21] Appl. No.: 165,384

[22] Filed: Jul. 3, 1980

[51] Int. Cl.[3] ..... E21D 5/01

[52] U.S. Cl. ..... 405/133; 294/86.25; 405/150

[58] Field of Search ..... 405/133, 146, 148, 150; 294/86.17, 96, 94, 86.25; 414/745, 747

[56] References Cited

U.S. PATENT DOCUMENTS

| | | | |
|---|---|---|---|
| 1,003,140 | 9/1911 | Lardy | 405/133 |
| 1,036,755 | 8/1912 | Vest | 294/94 |
| 1,749,827 | 3/1930 | Mack | 294/86.25 X |
| 2,650,477 | 9/1953 | Stine | 405/133 X |
| 2,728,600 | 12/1955 | Gray et al. | 294/96 |
| 3,293,865 | 12/1966 | Loofbourow et al. | 405/133 |
| 4,235,469 | 11/1980 | Denny et al. | 294/96 |
| 4,273,372 | 6/1981 | Sheshtawy | 294/86.25 X |

*Primary Examiner*—David H. Corbin

*Attorney, Agent, or Firm*—LeBlanc, Nolan, Shur & Nies

[57] ABSTRACT

In the mining of minerals from the earth, it is necessary to drill deep bore holes typically between 3000 and 6000 feet in the earth. In order to protect those entering the hole for additional mining operations, after drilling the hole, the hole is lined with a stack of specially constructed lining segments. These segments are formed of either prestressed concrete or steel. The segments are lowered one at a time into the bore hole so as to build up a stack within the hole, thereby lining the hole. The segments are carried to the hole on a transporter and then lowered by the transporter into the hole. Guide cables are threaded through guide conduits provided within the segments so as to maintain the orientation of such segments during the operation. The weight of the segment as it is lowered is supported by fluid, normally the drilling mud, that fills the hole and the transporter until the segment comes into contact with the top of the uppermost segment on the stack of those segments already placed into the hole. Grout is then placed between the lining segments and the inner wall of the bore hole. The grouting process is periodically carried out after every few segments have been placed into the hole. After the lining operation has been completed, the miners can enter the bore hole for other mining operations.

30 Claims, 10 Drawing Figures

Fig. 6
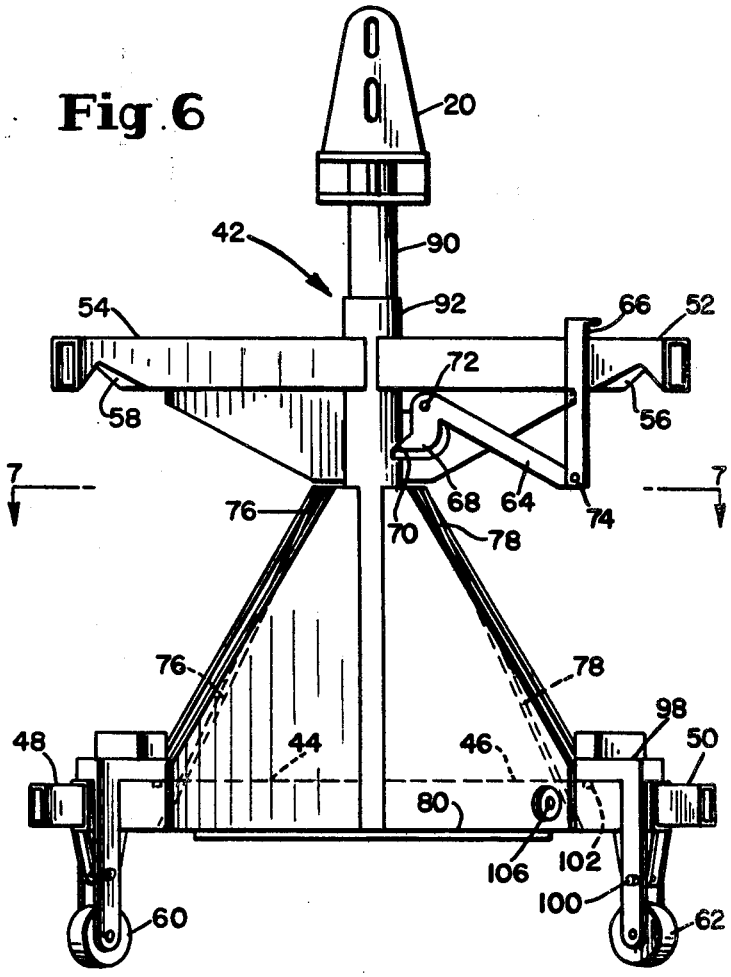
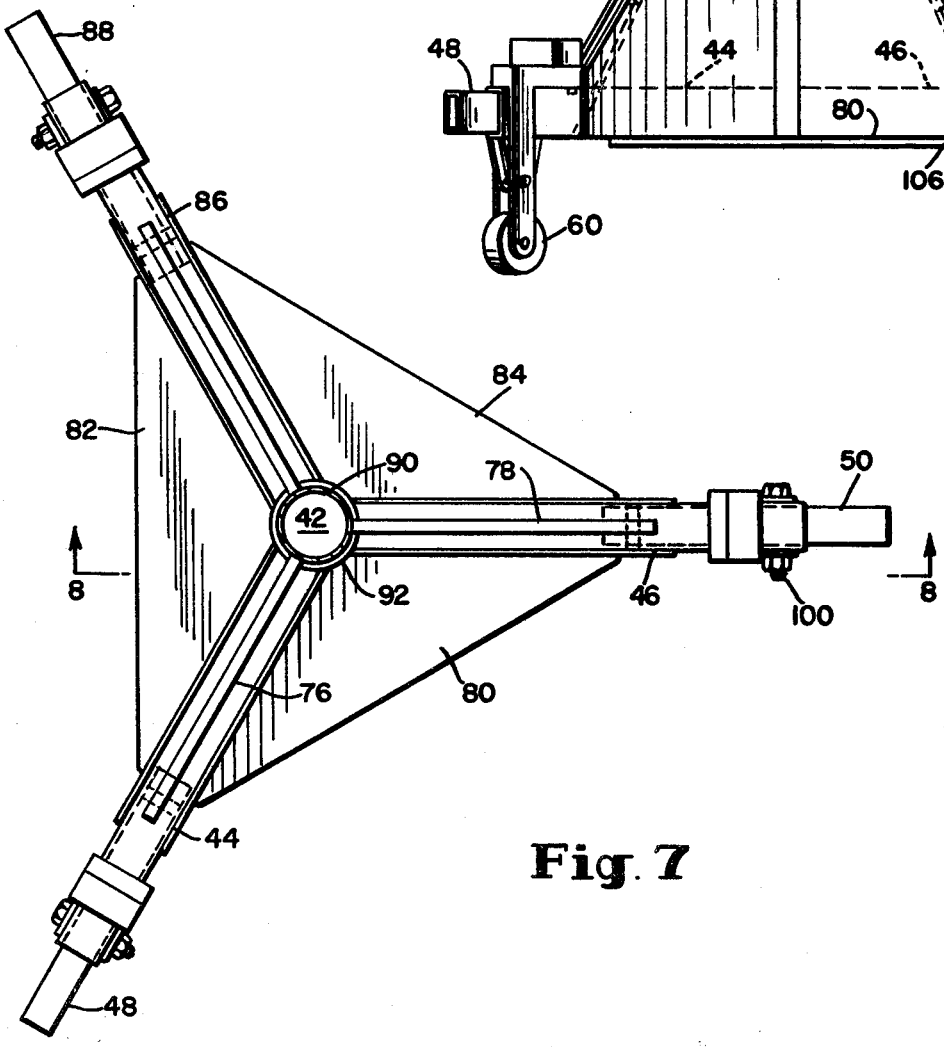
Fig. 7

MINE SHAFT LINER

RELATED APPLICATIONS

The present application is related to U.S. patent application Ser. No. 134,296 entitled BORE HOLE MINING and filed Mar. 26, 1980. The contents of such prior application are hereby incorporated by reference.

BACKGROUND OF THE INVENTION

The present invention relates to the lining of bore hole mine shafts drilled within the earth.

In the mining of minerals, extremely deep bore holes are initially made and then additional holes are extended from the central bore hole. In order to reach many of the mineral deposits within the earth, it is necessary for such holes to extend a depth of between 3000 and 6000 feet into the earth. With the present state of technology, however, the task of drilling such holes and lining the holes with a reinforcing material has been an extremely difficult operation. One type of system for use in such a bore hole mining operation is that system disclosed in the above-noted U.S. patent application Ser. No. 134,296.

In carrying out such mining operations in such bore holes, it is desirable to line the walls of the hole with a lining material. Typically, either steel or concrete lining segments have been used for lining the holes. A plurality of lining segments are stacked one upon another until the entire hole is appropriately lined. In placing the segments into the hole, the hole is filled with a fluid and such fluid is used to support the lining segment as it descends into the hole. The segments, one at a time, are aligned with the top opening of the hole and then released so as to slowly sink into the hole. Keeping in mind, that each of the segments will be in an equilibrium state when $$B-W-G=0$$

where B is the buoyancy force, G is the weight of the casing segment and W is the force of the water inside of the casing. By appropriately adjusting these three variables, each of the segments will be allowed to slowly sink into the hole once released.

Another type of system for lining large diameter bore holes is disclosed in U.S. Pat. No. 3,293,865 to Loofbourow et al. This patent discloses a process by which concrete sections are formed one at a time within the top portion of the bore hole and such sections are then lowered into the hole. More specifically, the disclosure of this patent involves the lining of large diameter deep bore holes by means of a continuous tubular reinforced concrete liner which is cast in a stationary slip form arranged at the top of the hole with such liners after being formed then being lowered into the hole. According to the patent, the holes have a diameter in excess of 3 or 4 feet up to 25 feet and extend for a depth up to 1600 feet. As the concrete lining elements sink into the hole they are supported by the use of fluid within the hole, such fluid being the drilling mud typically used in the drilling operations.

Numerous other devices for lining holes within the earth with either brick or concrete sections have been developed in the prior art. Exemplary of such devices are those shown by U.S. Pat. Nos. 1,003,140 to Lardy, 2,728,600 to Gray et al. and 3,250,076 to Jenkins et al.

The patent to Lardy discloses a system for lining shafts with concrete sections where each section is lowered one at a time into the shaft. The sections are supported by a platform held under the section as it is lowered into the hole. The top of each section is provided with an annular configuration and the bottom has a corresponding angularly configured groove.

In the patent to Gray, the hole within the earth is lined with a section formed by a plurality of bricks arranged on a specially constructed sleeve that is lowered into the hole with the bricks. When the bricks approach the brick section already in the hole, supporting brackets holding the bricks are retracted and the new section of bricks fall into place on top of the bricks already within the hole. The cylindrical sleeve that hold the bricks is then removed from the hole and a new set of bricks is arranged on the sleeve.

The patent to Jenkins discloses a system for lining a shaft within the earth. The system enables any number of prefabricated caisson sections to be lowered into an excavated shaft. The adjacent sections are joined before they are lowered into the shaft so that the joints between the sections themselves may be inspected for flaws before being lowered. In accordance with the procedures set forth in this patent to Jenkins et al. the lowermost caisson section is provided with a suitable support member and a plurality of lowering bars are fastened to such support member. The support member along with the lowering bars cooperate with a plurality of suitable lowering devices such as hydraulic jacks to lower the support member into the shaft. Since the support member must support the entire weight of the stack being formed, both the diameter and the length of the stack is extremely limited.

Other patents illustrating devices for lowering concrete or brick sections into a shaft for lining a shaft are shown in U.S. Pat. Nos. 158,434 to Newcomb, 491,956 to Sumner, 1,169,004 to Cargin, 2,650,477 to Stine and 2,670,233 to Barchoff. Each of these patents discloses a tool for holding a liner section as it is lowered into the shaft in the earth. These shafts being formed in the earth typically only extend to a relatively limited depth with the deepest being a well shaft for a water well such as disclosed in the patent to Sumner.

SUMMARY OF THE INVENTION

An object of the present invention is to provide an improved lining procedure and apparatus for lining large diameter bore holes within the earth.

Another object of the present invention is to provide an improved system for lowering lining segments into a bore hole formed within the earth.

A further object of the present invention is to provide an improved procedure for stacking cylindrical segments within a bore hole within the earth in order to line such bore hole.

Another object of the present invention is to provide an improved system for use in transporting and stacking a plurality of larger diameter cylindrical segments where each of the segments is fully supported until the segment is in contact with the uppermost end of the stack.

Still another object of the present invention is to provide an improved system for use in transporting and stacking a plurality of large diameter cylindrical segments for lining a shaft within the earth where each of the segments is lowered one at a time until such segment is arranged in contact with the top of the last segment lowered into the earth.

Still another object of the present invention is to provide an improved system for use in transporting and stacking a plurality of large diameter concrete cylindrical segments for forming a lining within a bore hole in the earth.

A still further object of the present invention is to provide improved cylindrical segments for lining a bore hole shaft within the earth where each segment is provided with radially extending openings for enabling the segment to be supported by radially extending arms and each segment is specially constructed so that when forming the stack any rubble on top of the uppermost segment on the stack is forced off when the new segment is lowered into position.

All of the above-noted objectives are achieved by the utilization of the improved system and process for transporting and stacking a plurality of large diameter cylindrical segments that are specially constructed in accordance with the present invention. The system of the present invention is capable of stacking a plurality of cylindrical segments within a bore hole within the earth. Each of the segments has a plurality of radially extending openings at a location near its base. The system is provided with a mandrel from which a plurality of retractable engagement arms radially extend. These retractable engagement arms are arranged near the lower end of the mandrel. Each of the arms projects into a corresponding radial opening in a segment that is to be transported and added to the stack of segments. These radially extending openings in the segment need not extend all the way through the cylindrical segment but need only extend a sufficient distance so as to receive the radially extending arms in order that the mandrel can support the weight of the cylindrical segment. Once the cylindrical segment is supported by the engagement arms on the mandrel, the segment is aligned with the opening of the bore hole and is lowered onto the stack.

The weight of the segment being added to the stack is held by the system until the segment comes into contact with the stack. The system can either fully support the weight of the segment or partially support the weight of the segment with the weight also being supported by fluid within the bore hole. Once the cylindrical segment reaches the top of the stack and it is in contact therewith, the engagement arms are retracted from the radial openings in the segment being added. Then the mandrel with the engagement arms can be withdrawn from the bore hole so as to be attached to the next segment to be added to the stack.

The retraction of the engagement arms from the segment only occurs when the segment is no longer supported by the transporting system. After the segment comes into contact with the stack, the mandrel continues to move in a downward direction into the opening of the core of the stack of segments. Such downward movement of the mandrel acts to cause the engagement arms to be retracted from the opening in the segment. For this purpose, rollers are provided on the end of the transport mechanism which sense the inner wall of the top segment already on the stack. Upon coming into contact with the inner wall of the top segment, the rollers cause a latch mechanism that held each of the engagement arms in place to be retracted. The mandrel then continues to move in a downward direction causing gussets attached thereto to force a pin attached to a slidable member of each of the engagement arms to move towards the mandrel thereby causing the slidable member to be retracted into the sleeve of the engagement arm. The mandrel with the engagement arms then in the retracted position is withdrawn from the bore hole back to the surface of the earth. The engagement arms are then reextended so as to enter the radial openings in a new cylindrical segment to be lowered into the bore hole.

When initially starting the procedure for forming the stack of elements, a solid layer of grout is placed on the bottom of the shaft hole. This layer of grout is then dressed with the drill bit so that its surface is perpendicular to the walls of the shaft. This ensures that the stack as formed will be parallel with the walls of the shaft. After a few cylindrical segments have been placed in the hole, grout is applied between the outer walls of the segment and the wall of the hole. This grout is then periodically supplied after a certain number of segments have been lowered into the hole. Thus, for example, after every five segments have been lowered into the hole more grout is added.

The cylindrical segment that is used for forming the liner of the hole has a plurality of radially extending openings at a location near its base. These openings serve to receive the radially extending arms of the transport mechanism. As previously noted, these openings need not extend all the way through the wall of the cylindrical member but only need extend a sufficient distance so that proper engagement can be made between the transport mechanism and the cylindrical segments for supporting such segment. A reinforcing member surrounds at least the top of each of the radially extending openings. A plurality of longitudinally extending openings are formed within each of the segments, which openings form conduits through the segment. These longitudinally extending openings serve as guide conduits for steel ropes that pass through the segment for guiding the segment as it is lowered into the earth. A top portion of the segment is provided with an approximately V-shaped cross-sectional area and a bottom portion of the segment is provided with a groove corresponding to the shape of the top portion so that the segment can be stacked on top of a similarly shaped segment. The V-shaped top and the groove in the bottom of the segment has an angle of between 60° and 120°, with the preferable angle being 90°.

The cylindrical segment is constructed of prestressed concrete having an inner diameter of at least 10 feet and preferably approximately 14 feet. The thickness of the concrete wall is approximately 2 feet so that the outer diameter of the segment is 18 feet. The segment has an effective casing pressure resistance of over 1000 psi and preferably over 1200 psi. The relatively high casing pressure resistance of the cylindrical segment enables the segment to be lowered within a bore hole extending to depth in excess of 3000 feet. The length of each segment is approximately 10 feet. Each segment weighs approximately 75 tons.

The procedure of lining a bore hole with concrete cylindrical lining elements in accordance with the present invention relies upon the use of a transporting mechanism for lifting each of the segments one at a time from a location adjacent to the hole and lowering the segments into the hole and upon the use of standard equipment for maintaining fluid within the hole. The fluid that is maintained within the hole is typically the drilling mud used during the drilling operation. Thus, before beginning the lining operation, the hole should be substantially filled with fluid. The filling of the hole with fluid also serves to prevent any crumbling of the walls of the hole during the lining operation.

Each segment is lifted one at a time from a location adjacent to the hole and lowered into the hole. The weight of each segment being lowered continues to be supported by the fluid within the hole and the transporting mechanism until the segment comes into contact with the uppermost end of the stack of segments. The segment is retained on the transporting mechanism by radial arms that project into the radial openings in the segment. These arms are retained in contact with the segment and prevented from withdrawing from the segment until the weight of the segment being lowered has transferred from the transporting mechanism to the stack of segments. After the segment comes into contact with the stack of segments and its weight has been transferred to the stack, the arms of the transporting mechanism are withdrawn from the radial openings in the segment. As the segments are lowered into the hole, they are guided by steel guide ropes that extend through longitudinal conduits within the segment.

After a certain number of segments have been placed into the hole, grout is applied between the outer wall of the segments and the inner wall of the hole. This grout is periodically supplied during the lining operation after a certain number of lining segments have been placed into the hole. When initiating the lining operation, a grout plug is formed on the bottom of the bore hole. The grout plug is preferably about 8 feet thick. After the plug is formed, the plug is dressed with the drill bit in a drilling operation so as to ensure that the surface of the plug is perpendicular to the wall of the hole.

The concrete liners must be constructed so as to be able to withstand 0.5 psi per foot of depth, this is the collapse pressure resistance of the liner. Thus, if the hole extends 3000 feet, the collapse pressure resistance of the concrete segments should be in excess of approximately 1500 psi. For a 3000 foot hole the compressive strength of the material of the concrete lining segment should exceed 5000 psi so as to be able to withstand the weight of the segments in the stack.

As a new segment is being lowered, any rubble that might be present on top of the prior segment added to the stack is pumped out by the turbulence created by the descending segment. The pumping effect is created since the hole is filled with a fluid during the lining operation. The creation of such turbulence and the resulting pumping effect for clearing off the rubble is maximized by providing the top of the segment and the bottom of the segment with an angular configuration of 45° with respect to the horizontal on each side. Thus the top portion and the bottom groove each incorporate a 90° angle.

FIG. *3a* is a side elevational view showing a cylindrical element being lowered into a bore hole and added to a stack of elements already within the hole.

FIG. *3b* is a side elevational view showing a stack of elements formed within a hole with the transporting mechanism being withdrawn from the hole for picking up another cylindrical segment.

FIG. *4a* is a side elevational cross-sectional view of a concrete cylindrical segment formed in accordance with the present invention.

FIG. *4b* is a top plan view of the concrete cylindrical segment shown in FIG. *4a*.

Figure 5:
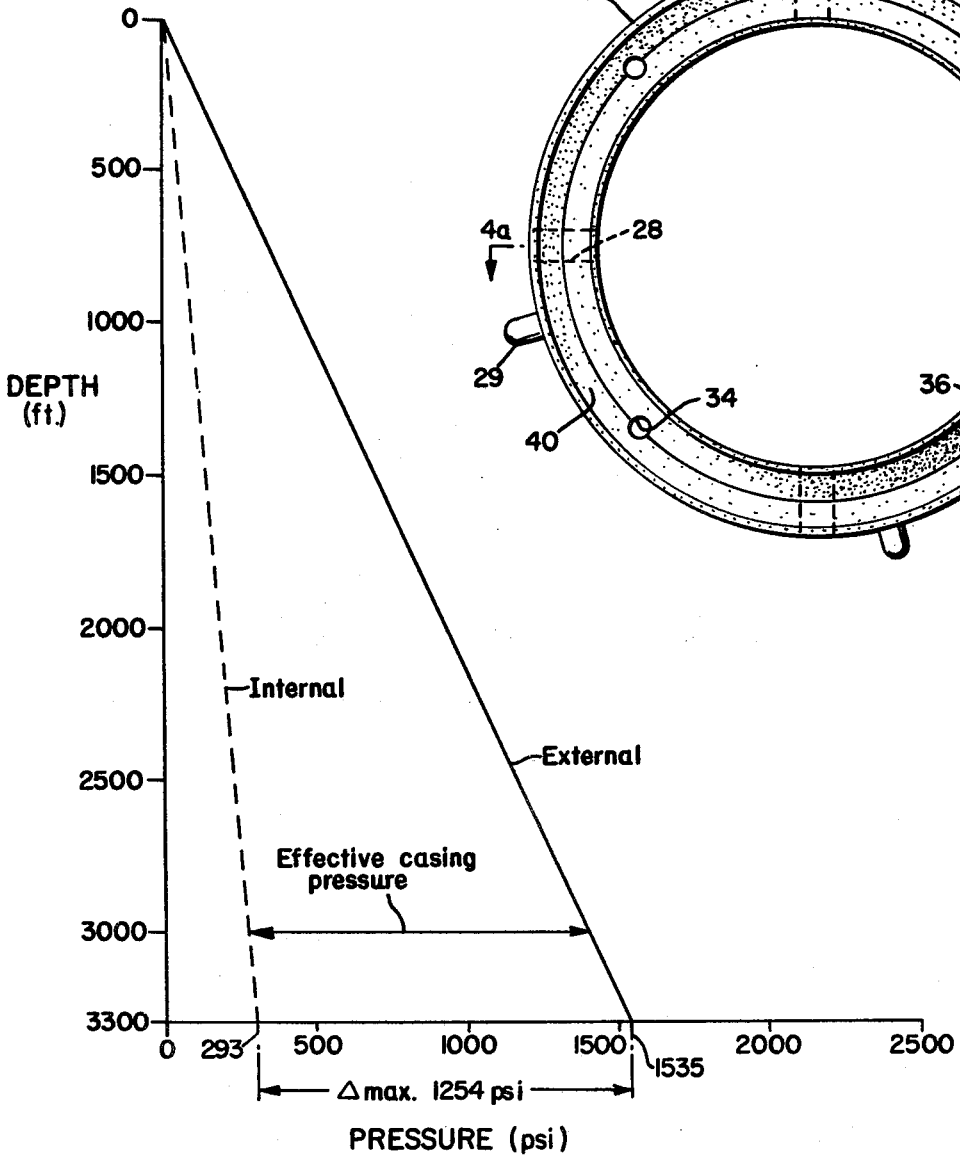

FIG. 5 is a graph illustrating the relationship between the depth to which the cylindrical segments are to be lowered and the pressure on the inner and outer walls of such segment where the segment is formed of concrete.

FIG. 6 is a side elevational view of a transporting mechanism in accordance with the present invention.

FIG. 7 is a top plan view of the transporting mechanism taken along lines A—A in FIG. 6.

Figure 8:
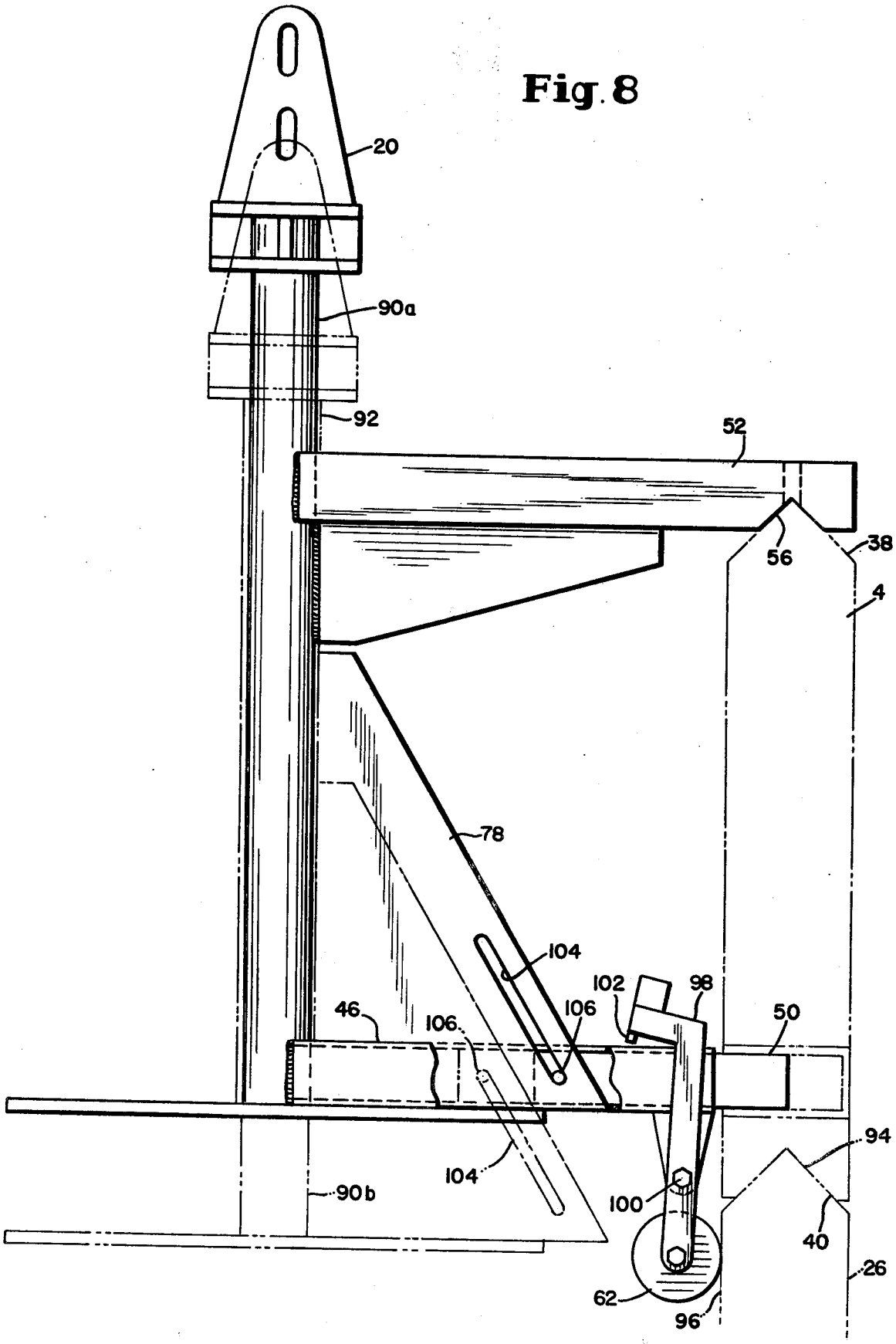

FIG. 8 is an enlarged side elevational view of a portion of the transporting mechanism in accordance with the present invention.

DESCRIPTION OF THE PREFERRED EMBODIMENTS

Figure 1:
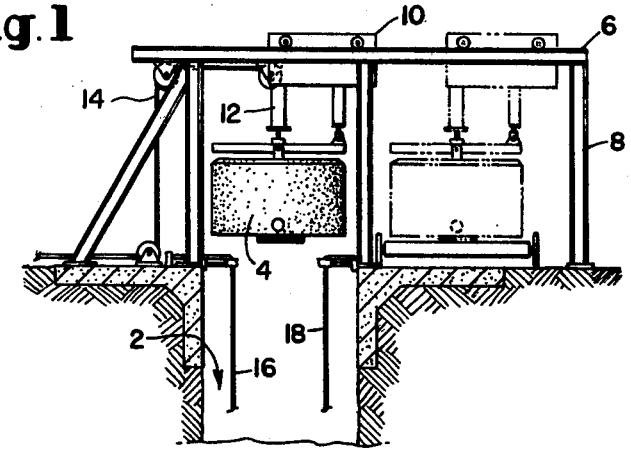
FIG. 1 is a side elevational view illustrating one embodiment of a transporting system for lowering cylindrical segments into a bore hole in accordance with the present invention.

A bore hole 2 that has been drilled into the earth can be lined with a plurality of cylindrical segments, such as segment 4, that are lowered into the hole by a transporting mechanism such as shown in FIG. 1. Transporting mechanism 6 picks up the segment that is to be lowered from a location adjacent the hole and with an overhead crane 10 arranges the segment over the opening to the hole. The segment is then lowered into the hole utilizing an hydraulic mechanism 12. The segment as it is lowered is supported by a steel rope 14 and is guided by steel guide ropes such as ropes 16 and 18. Guide lines 16 and 18 pass through longitudinally extending openings in the cylindrical segment and extend through all of the segments as the stack is formed. While FIG. 1 illustrates one embodiment of the transporting mechanism, another, and preferred, embodiment is described below in conjunction with later figures.

Figure 2:
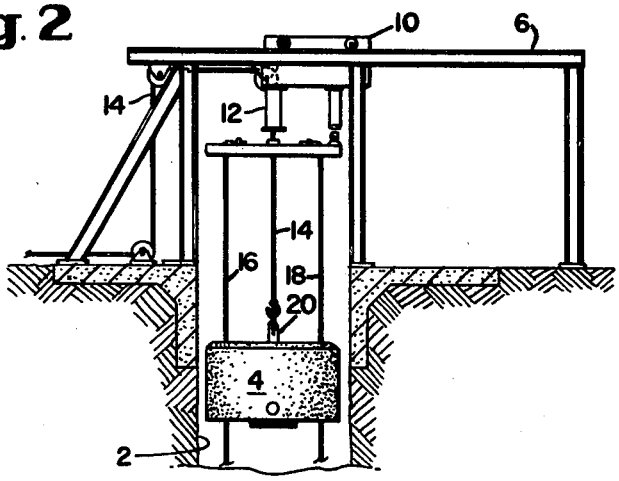
FIG. 2 is another view of the system illustrated in FIG. 1 showing the cylindrical segment partially lowered into the hole.
Figure 3A:
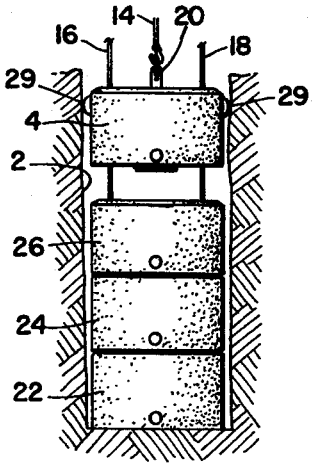
Figure 3B:
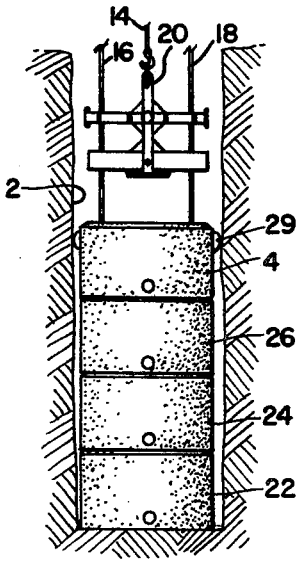

As shown in FIG. 2, after guide lines 16 and 18 have been threaded through the longitudinal openings in segment 4, hydraulic mechanism 12 lowers support line 14 which is attached to mounting bracket 20. Attached to mounting bracket 20 is the support mechanism for supporting cylindrical segment 4 as it is lowered into the hole. As cylindrical segment 4 is lowered into the hole, it is added to a stack of cylindrical segments 22, 24 and 26 already formed in the hole (see FIG. *3a*). After segment 4 has come to rest on top of segment 26, the support member is withdrawn from segement 4 and drawn back to the surface of the earth by withdrawing support line 14. Thus a stack of cylindrical segments 22, 24, 26 and 4, such as shown in FIG. *3b*, is formed within bore hole 2. Upon withdrawal of the support member, a new cylindrical segment is picked up from the location adjacent to the hole and then lowered into the hole for continuing the formation of the liner for the bore hole. After several cylindrical segments have been stacked within the hole, grout can be added between the outer wall of the segments and the inner wall of the hole by any type of conventionally known equipment. The grout is then periodically supplied after a certain number of cylindrical segments have been arranged in the hole such as every third, fourth or fifth segment.

Figure 4A:
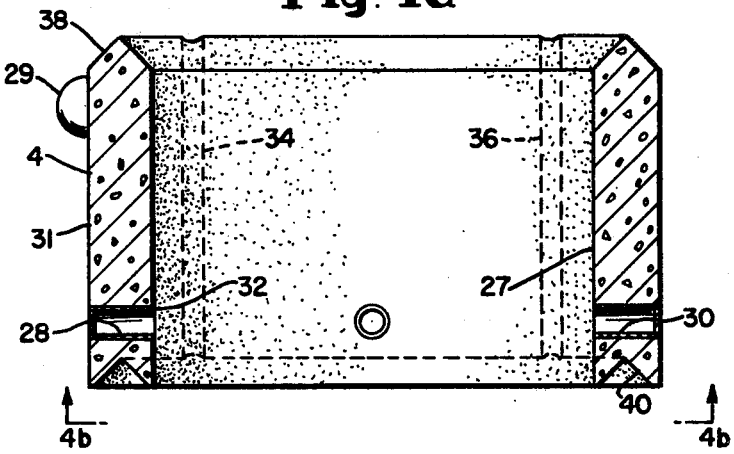
Figure 4B:
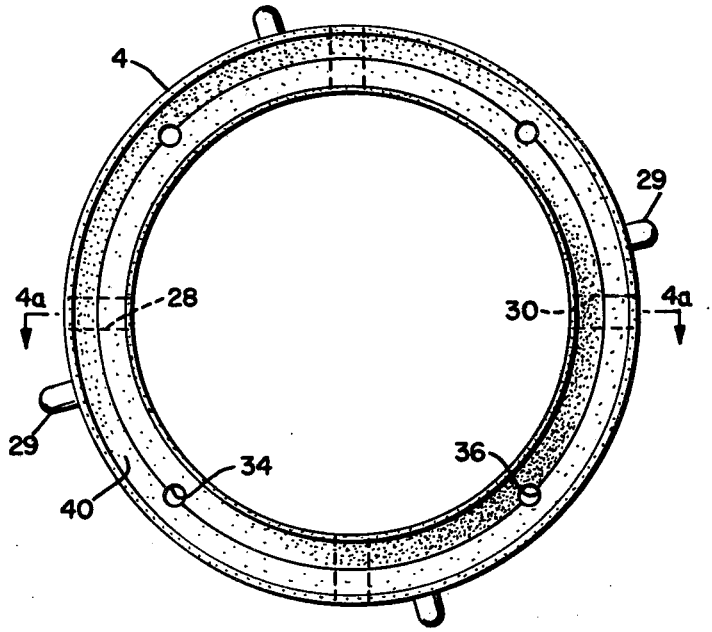

While the cylindrical segments can be formed from either concrete or steel, it is preferable to construct the segments from a prestressed concrete. A cross-sectional view of such concrete cylindrical segment is illustrated in FIG. 4a. *Cylindrical segment 4 has an inner wall 27 and an outer wall 31. Extending in a radial direction near the bottom of segment 4 from inner wall 27 are a plurality of openings such as openings 28 and 30. The number of such openings are typically either three or four openings with the openings being equidistantly spaced around the inner wall. While the openings need not extend all the way through the wall, the open portion must be facing the inner portion of the cylindrical segment. Each of the radial openings should be reinforced by a reinforcing material 32 which can be a steel pipe that extends into the opening. Positioned around the outer wall are a plurality of centralizers such as 29, formed from an epoxy material. These centralizers need only be placed on every third or fourth lining segment or as needed. Extending in a longitudinal direction through the wall of segment 4 are a plurality of longitudinal openings such as openings 34 and 36. These longitudinally extending openings serve as the guide channels for the guide lines, such as steel lines 16 and 18.*

The top of each of the segments is formed with a V-shaped construction such as top portion 38. A corresponding groove 40 is provided in the bottom of segment 4. The grooved portion need not extend to the very periphery of the inner and outer wall but can stop slightly short thereof so as to leave approximately a two inch horizontal portion on each end. Thus, each segment at its top end enters into a corresponding groove at the bottom end of the next segment. Preferably, each side of the V-shaped construction of top end 38 and each side of groove 40 should be approximately 45° with respect to the horizontal or otherwise stated the V-shaped portion and the groove each should encompass an angle of 90°. The inner diameter of segment 4 is preferably approximately 14 feet and the outer diameter is approximately 18 feet. Thus the wall thickness of segment 4 is approximately 2 feet. The length of each segment is approximately 10 to 11 feet.

In forming the prestressed concrete segment 4, the segment must be capable of withstanding the pressure differential between the pressure on the inside wall and the outside wall of the fluid within the hole. As shown by the graph in FIG. 5, the effective casing pressure on the internal wall is illustrated by the dashed lines while the pressure on the outside wall is shown by the solid line. The lines in the chart have been plotted with respect to a concrete cylinder having an inner diameter of 14 feet and an outer diameter of 18 feet. This pressure obviously increases with the depth of the hole. The effective casing pressure is the differential between the pressure on the inside and outside walls of the cylindrical segment. Thus, for a concrete segment such as described above, the effective casing pressure resistance should be in excess of 1000 psi in order to be able to use the segment at 3000 feet or more preferably in excess of 1200 psi. At 3300 feet as shown in the graph of FIG. 5, the pressure differential is 1254 psi. The pressure relationship illustrated by the graph of FIG. 5 has been calculated utilizing a pressure gradient of 67 pounds per cubic foot of mud.

If the cylindrical segment is formed of steel, the thickness of the wall is significantly less, typically on the order of a few inches as compared to the 2 foot thickness of the concrete wall. Hence, when using a steel cylindrical segment, the pressure differential between the pressure on the outside and inside of the wall is significantly lower. For example, at 3300 feet, for a steel cylinder having an outer diameter of 18 feet and a wall thickness of 2.83 inches, the effective casing pressure resistance must be 674.6 psi.

A preferred embodiment of the supporting portion of the transport mechanism is illustrated in FIGS. 6, 7 and 8. The support mechanism has a mandrel 42 that is attached to mounting bracket 20. Mandrel 42 includes a stationary sleeve 92 and a slidable member 90 that passes through sleeve 92. At the lower end of mandrel 42 there are attached a plurality of radial arms such as arms 44 and 46 shown in FIG. 6 and arm 86 shown in FIG. 7. Each of the radial arms have a sliding member, 48, 50 and 88 that can either extend from or retract into the sleeve of the respective radial arm. The end portions of the sliding members are the sections that enter into the radial openings in the cylindrical segment. The number of radial arms and sliding members and their locations must be arranged to correspond with the number and locations of the radial openings in the cylindrical segments. Typically there are either three or four radial openings and correspondingly three or four radial arms. The radial openings and the radial arms are equidistantly spaced around the central axis.

While the sliding members 48, 50 and 88 engage the cylindrical segment near its bottom end, cross-head structural members 52 and 54 engage the top of the cylindrical segment in order to stabilize the segment as it is being lowered into the bore hole for preventing any tilting of the segment. Normally the number of cross-head structural members correspond to the number of engagement arms. Structural members 52 and 54 have grooved portions 56 and 58 that come into contact with the V-shaped section at the top of the cylindrical segment thereby securing the segment between the radial arms and the cross-head structural members.

Attached to one of the structural members, such as member 52 as shown in FIG. 6 is a latch mechanism 64. This latch mechanism acts to retain sliding member 90 in its lower position, as further explained below. Latch mechanism 64 includes a latch arm 66 attached to the cross-head 52 and a latch pin 68 that is capable of entering opening 70 in mandrel 92. Latch pin 68 is pivoted about pivot point 72 and arm 66 pivots about pivot point 74. When the slidable member 90 is lowered into its lower position there is an opening in slidable member 90 into which latch pin 68 can enter upon pivoting of the weight of the latch mechanism 64 and arm 66 thereby locking slidable member 90 in such lower position. Slidable member 90 is then retained in such position until latch pin 68 is removed from the opening in slidable member 90. This latch mechanism has not been illustrated in FIG. 8 for the sake of clarity in that figure.

Arranged at the bottom end of the support mechanism are a plurality of sensing rollers such as rollers 60 and 62. There is one sensing roller associated with each of the radial arms. These rollers act to allow the sliding members of the associated radial arms to be retracted into the sleeve of the arm when the cylindrical segment comes into contact with the previously lowered cylindrical segment, as will be further explained below in connection with FIG. 8. Associated wtih each of the radially extending arms is a gusset such as gussets 76 and 78. Interconnecting the radially extending arms can be interconnecting gussets such as gussets 80, 82 and 84, which are shown in FIG. 7.

As the cylindrical segment supported by the support mechanism is lowered into contact with the uppermost segment on the stack, the sensing rollers are pivoted inwardly. As shown in FIG. 8, roller 62 comes into contact with inner wall 96 of segment 26 thereby pivoting roller 62 about pivot point 100 so as to move in an inward direction. In turn, this pivots support arm 98 thereby withdrawing pin 102. Previously, pin 102 had passed through an opening in the sleeve of radial arm 46 and into engagement with an opening in sliding member 50 when member 50 was in its extended position. Thus, sliding member 50 is prevented by pin 102 from being retracted into the sleeve of radial arm 46 until groove 40 on segment 4 contacts top portion 94 above segment 26. After segment 4 rests upon segment 26 and the weight of segment 4 is no longer supported by the support mechanism the withdrawal of pin 102 allows for sliding member 50 to be retracted into the sleeve of arm 46.

The mandrel is then further moved in a downward direction. Thus, top portion 90*a* assumes the position shown by the dashed lines in FIG. 8 while the bottom portion 90*b* of slidable member 90 extends from the bottom of the support member. When this happens, the gussets such as gusset 78 are moved with slidable member 90 in a downward direction. Gusset 78 has a slot 104 therein through which a pin 106 that is attached to sliding member 50 passes. Since radial arm 46 is welded to the sleeve 92 of the mandrel, as gusset 78 moves downwardly with respect to sleeve 92, slot 104 causes pin 106 to move in an inward direction thereby retracting arm 50 into the sleeve and withdrawing the outer portion of arm 50 from the radial opening in segment 4. When slidable member 90 is moved downwardly far enough, latch pin 68 will enter an opening in slidable member 90 thereby locking it in its lower position. In such lower position, the sliding members of the radial arms are fully retracted from the radial openings in the cylindrical segment. The support member now can be retracted from the cylindrical segment and from the bore hole. The support member is then drawn back up to the surface of the earth where it is secured to a new cylindrical segment to be lowered into the hole.

The following description will provide an explanation of the operation of the lowering of the cylindrical segments into the bore hole one at a time. The cycle begins with the support member supporting a liner segment that is ready to be lowered into the shaft by means of the hydraulic cylinder 12 and support line 14. The three radial arms, 44, 46 and 86 have their slidable members 48, 50 and 88, respectively, positioned in corresponding radial openings in segment 4. Segment 4 is prevented from tilting by the cross-head structure formed by structural members 52 and 54. The liner segment and the support mechanism are guided on a plurality of guide lines such as lines 16 and 18. The weight of liner segment 4 is transferred from the radial arms to the mandrel 42 to the mounting bracket 20 and from there to support line 14. The segment then is lowered into bore hole 2.

When segment 4 which is being lowered approaches segment 26 which is the uppermost segment in the stack, the sensing wheel such as wheel 62 of the safety latch mechanism rolls along the inner side of top portion 94 and then is pushed inwardly by inner wall 96 of segment 26. The inward movement of wheel 62 pivots support arm 98 about pivot point 100 thereby lifting pin 102 out of a corresponding opening in the sleeve of arm 46 and an opening in sliding member 50. The same operation occurs with respect to all three radially extending arms.

As the liner segment comes to rest on top of segment 26 that is already in place, the weight of the support assembly is transferred to the cross-head structural members 52 and 54 and to the top of liner segment 4 that has just been put into place. The cross-head and the support assembly are now stationary. Slidable member 90 of mandrel 42, however, continues to travel in a downward direction approximately two feet. As slidable member 90 of the mandrel travels downwardly the sliding members of the radial arms are retracted. The retraction of the sliding members is caused by the downward movement of the mandrel gussets such as gusset 78 which causes a pin 106 to move along slot 104 in the gusset so as to be retracted in an inward direction towards the central axis. When slidable member 90 reaches the bottom of its travel and the sliding members of the radial arms are retracted, a latch 68 engages a slot in slidable member 90 thereby preventing the mandrel from moving in an upward direction. The support tool now can be withdrawn from the bore hole with the radial arms remaining in their retracted position.

On the surface, the entire tool is placed into another liner segment to be lowered into the hole. Latch 68 is manually released and the radial arms are extended into engagement with the radial openings in the new liner segment to be lowered into the hole. Then the entire operation is repeated.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A system for use in transporting and stacking a plurality of large diameter cylindrical segments, each of the cylindrical segments having a plurality of radially extending openings at a location near its base, said system comprising: a mandrel; a plurality of retractable engagement arms, said arms being elongated and radially extending from a lower end of said mandrel; each of said arms including an elongated housing attached to said mandrel and a slidable member arranged within said housing for longitudinal axial movement therein; means for causing each of said slidable members to project in a radial direction so as to extend into a corresponding radial opening in a segment for supporting such segment to be transported and added to a stack; means for retaining the weight of the segment being added to the stack on said system before the segment is in contact with the stack; retraction means for causing said slidable members to be radially retracted from the openings in the segment in response to the transfer of the weight of said segment to the stack, said retraction means including gusset means coupled to said slidable members for retracting said slidable members from such radial openings in a cylindrical segment; and means for preventing retraction of said slidable members until the weight of the segment has been transferred from said system to the stack, said means for preventing retraction acting between said elongated housings and said slidable members and positioned to prevent retraction until direct contact of the stack therewith.

2. A system according to claim 1 wherein when lowering a segment onto a stack said mandrel is capable of further progressing in a downward direction after the segment contacts the stack and its weight is supported by the stack and said means for retracting said slidable members operates in response to such further movement of said mandrel.

3. A system according to claim 1, or 2 further comprising a plurality of guide ropes, each of said guide ropes extending through a corresponding longitudinally extending guide channel in a segment.

4. A system according to claim 2 wherein said means for preventing retraction of said slidable members includes a locking member associated with each of said arms for engaging said arm slidable members when in its extended position and preventing retraction of said arm slidable member.

5. A system according to claim 4, wherein said locking member engages said slidable member for preventing movement within said housing when said arm is to remain in its extended position.

6. A system according to claim 5 wherein each of said locking members is withdrawn from engagement with the corresponding said slidable member when the weight of the segment is transferred to the stack and said mandrel further moves in a downward direction.

7. A system according to claim 6 wherein said gusset means for retracting said slidable members includes a plurality of gussets, each of said gussets being coupled between said mandrel and one of said slidable members of said arms, each of said slidable members has a pin member coupled thereto, said pin member is arranged in engagement with a corresponding one of said gussets, and each of said gussets causes the respective said pin to retract the corresponding said slidable member when said mandrel moves in a downward direction.

8. A system for use in transporting and stacking a plurality of large diameter cylindrical segments, said system comprising: a mandrel; a plurality of retractable engagement arms radially extending from a lower end of said mandrel; each of said arms includes an elongated housing attached to said mandrel and a slidable member arranged for longitudinal axial movement within said housing; means for causing each of said slidable members to project into engagement with a segment to be transported and added to a stack of segments; means for causing said slidable members to be retracted from engagement with the segment in response to the transfer of the weight of said segment to the stack; said means for retracting said slidable members includes a plurality of gussets; each of said gussets being coupled between said mandrel and one of said slidable members of said arms; each of said slidable members has a pin member coupled thereto; said pin member is arranged in engagement with a corresponding one of said gussets; and, each of said gussets including means for causing the respective said pin to retract the corresponding said slidable member when said mandrel moves in a downward direction, and means for preventing retraction of both said slidable members until the weight of the segment has been transferred from said system to the stack, said means for preventing retraction acting between said elongated housings and said slidable members and positioned to prevent retraction until direct contact of the stack therewith.

9. A system according to claim 8 wherein when lowering a segment onto a stack said mandrel is capable of further progressing in a downward direction after the segment contacts the stack.

10. A system according to claim 9 wherein said means for retracting said arms operates in response to such further movement of said mandrel.

11. A system according to claim 10 wherein said means for preventing retraction of said arms includes a locking member associated with each of said arms for engaging said slidable member of said arm when in its extended position and preventing retraction of said slidable member into said housing.

12. A system according to claim 11 wherein each of said locking members is withdrawn from engagement with the corresponding said slidable member when the weight of the segment is transferred to the stack and said mandrel further moves in a downward direction.

13. A system according to claims 8, 9, or 10 further comprising a plurality of guide ropes, each of said guide ropes extending through a corresponding longitudinally extending guide channel in a segment.

14. A system for lining a bore hole with a stack of cylindrical lining segments, the system comprising: a plurality of cylindrical lining segments, each of said segments having a plurality of radially extending openings at a location near its base and a plurality of longitudinally extending openings that form conduits through said segments; fluid means provided within the hole during a lining operation for partially supporting the weight of each of said segments as it is lowered into the hole; and, a transporting mechanism having a plurality of retractable engagement arms radially extending into said radially extending openings during lowering of segments down into said hole one at a time from a location adjacent to the hole and lowering such said segment into said hole and said transporting mechanism acting to support a substantial portion of the weight of each of said segments as it is lowered into the hole until said segment reaches the bottom of the hole or the top of the stack of said segments already formed in the hole, and said transporting mechanism having means for causing said arms to be retracted from the openings in the segment in response to the transfer of the weight of said segment to the stack or the bottom of the hole.

15. A system according to claim 14 wherein said means for maintaining fluid within the hole maintains enough fluid for partially supporting the weight of each of said segments as such segment is lowered into the hole.

16. A system according to claim 14 further comprising grout to be supplied between the outer walls of said segments and the wall of the hole with such grout being periodically supplied after a certain number of said segments have been lowered into the hole.

17. A system according to claim 16 further comprising a layer of grout formed on the bottom of the hole prior to lowering the first of said segments into the hole.

18. A system according to claim 14 wherein said transporting mechanism includes: a mandrel; a plurality of retractable engagement arms radially extending from a lower end of said mandrel; means for causing each of said arms to project into one of said radial openings in one of said segments to be lifted and added to a stack of segments; means for lowering said segment onto the stack; means for retaining the weight of said segment being added to the stack on said mechanism before said segment is in contact with the stack; and means for causing said arms to be retracted from said radial openings in said segment.

19. A system according to claim 18 wherein said means for retracting said arms acts to retract said arms when the weight of said segment is transferred to the stack and is no longer supported by said mechanism.

20. A system according to claim 19 further comprising means for preventing retraction of said arms until the weight of said segment has been transferred from said mechanism to the stack.

21. A system according to claim 20 wherein when lowering a segment onto a stack said mandrel is capable of further progressing in a downward direction after the segment contacts the stack and its weight is supported by the stack and said means for retracting said arms operates in response to such further movement of said mandrel.

22. A system according to claim 21 wherein said means for preventing retraction of said arms includes a locking member associated with each of said arms for engaging said arm when in its extended position and preventing retraction of said arm.

23. A system according to claim 22 wherein each of said arms includes an elongated housing attached to said mandrel and a slidable member arranged within said housing and said locking member engages said slidable member for preventing movement within said housing when said arm is to remain in its extended position.

24. A method for lining a bore hole with a stack of cylindrical lining segments wherein the system or carrying out the lining operation includes a plurality of cylindrical lining segments, each of the segments having a plurality of radially extending openings at a location near its base and a plurality of longitudinally extending openings that form conduits through the segment, the provision of a substantial quantity of fluid within the hole during a lining operation, and a transporting mechanism for lifting each of the segments one at a time from a location adjacent to the hole and lowering the segment into the hole, said procedure comprising the steps of: substantially filling the hole to be lined with fluid; lifting the segments for forming the hole liner one at a time from a location adjacent to the hole and lowering such segment into the hole; supporting the weight of the segment being lowered into the hole by the fluid within the hole and the transporting mechanism; retaining the segment being lowered into the hole on the transporting mechanism by radial arms of the transporting mechanism projecting into the radial openings in the segment; and retaining the arms of the transporting mechanism in contact with the segment and withdrawing the retaining arms from the radial openings in response to the transfer of the weight of said segment to the stack of segments already in the hole.

25. A method according to claim 24 further comprising the step of withdrawing the arms of the transporting mechanism from the radial openings in the segment after such segment has come into complete contact with the uppermost segment of the stack in the hole.

26. A method according to claim 25 further comprising the step of guiding the lowering of the segment into in the hole by passing a rope through each of the longitudinal openings in the segment.

27. A method according to claim 26 further comprising the step of applying grout between the outer wall of the segments and the inner wall of the hole periodically during the lining operation after a certain number of lining segments have been placed into the hole.

28. A method according to claim 27 further comprising a step of forming a grout plug approximately 8 feet thick on the bottom of the hole prior to lowering the first cylindrical lining segment into the hole and after forming such plug dressing such plug with a drill bit in a drilling operation so as to ensure that the surface of the plug is perpendicular to the wall of the hole.

29. A method according to claim 24, 25 or 26 wherein the liner being formed extends to a depth in excess of 3000 feet.

30. A method according to claim 29 wherein the liner being formed extends to a depth of between 3000 and 6000 feet.

* * * * *

UNITED STATES PATENT AND TRADEMARK OFFICE

CERTIFICATE OF CORRECTION

PATENT NO. : 4,460,293

DATED : July 17, 1984

INVENTOR(S) : Paul Richardson et al

It is certified that error appears in the above—identified patent and that said Letters Patent is hereby corrected as shown below:

Column 7, lines 2 through 20 should not be in italics.

Claim 4, lines 11 and 12, delete "arm".

Signed and Sealed this

*Twenty-fifth* Day of *December 1984*

[SEAL]

*Attest:*

GERALD J. MOSSINGHOFF

*Attesting Officer*

*Commissioner of Patents and Trademarks*